United States Patent [19]

Nixon et al.

[11] 4,166,538

[45] Sep. 4, 1979

[54] EASY OPENING ENVELOPE

[75] Inventors: Bill M. Nixon, Lewisville; Perry A. Thornburg, Mesquite, both of Tex.

[73] Assignee: Champion International Corporation, Stamford, Conn.

[21] Appl. No.: 928,231

[22] Filed: Jul. 26, 1978

[51] Int. Cl.[2] ..... B65D 27/38

[52] U.S. Cl. ..... 206/628; 206/629

[58] Field of Search ..... 206/629, 610, 628

[56] References Cited

U.S. PATENT DOCUMENTS

| | | | |
|---|---|---|---|
| 1,336,646 | 4/1920 | Mendenhall | 206/629 |
| 1,984,901 | 12/1934 | Swift | 229/71 |
| 2,083,158 | 6/1937 | Ramsey | 206/620 |
| 3,322,329 | 5/1967 | Castaneda et al. | 206/629 |
| 4,093,074 | 6/1978 | Bielawski | 206/629 |

FOREIGN PATENT DOCUMENTS

| | | | |
|---|---|---|---|
| 243424 | 6/1960 | Australia | 206/629 |
| 636634 | 2/1962 | Canada | 206/610 |

*Primary Examiner*—Stephen P. Garbe

*Attorney, Agent, or Firm*—Evelyn M. Sommer

[57] ABSTRACT

An easy opening envelope has a rectangular front panel, a substantially rectangular back panel which faces the front panel and is connected to it at a fold line at the bottom edge of the panels, first and second side flaps which can be folded inwardly and which have an adhesive coating which secures the back panel in place, and an envelope flap extending the full width of the front panel. The back panel has a tear panel defined by perforations extending generally parallel to the upper edge of the back panel. Adhesive strips on the envelope flap are in registry with the tear panel when the envelope flap is closed. To open the envelope, the flap is gripped and pulled away from the back panel to cause the tear panel to be stripped away.

2 Claims, 3 Drawing Figures

Fig. 1.
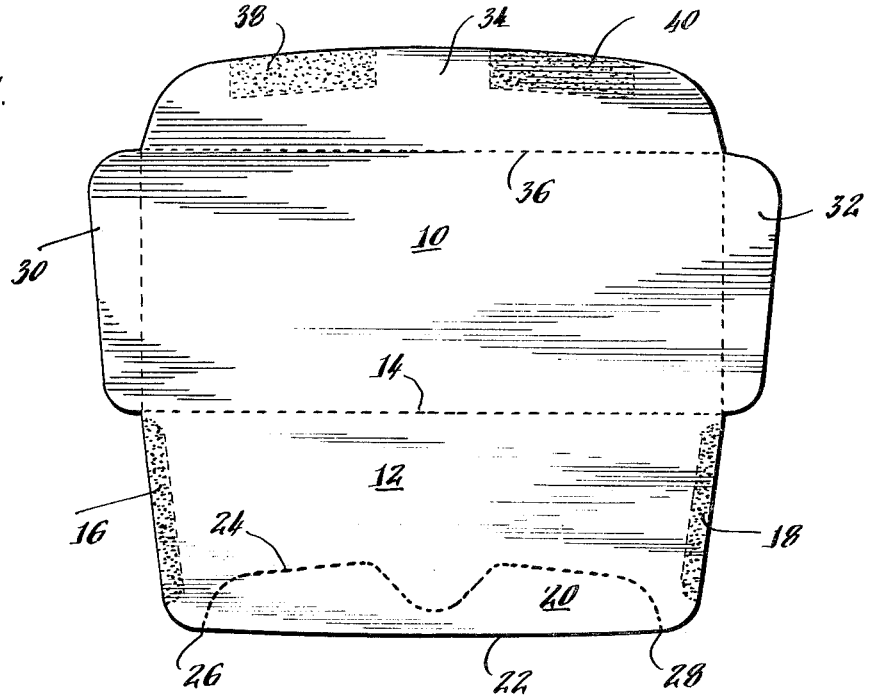
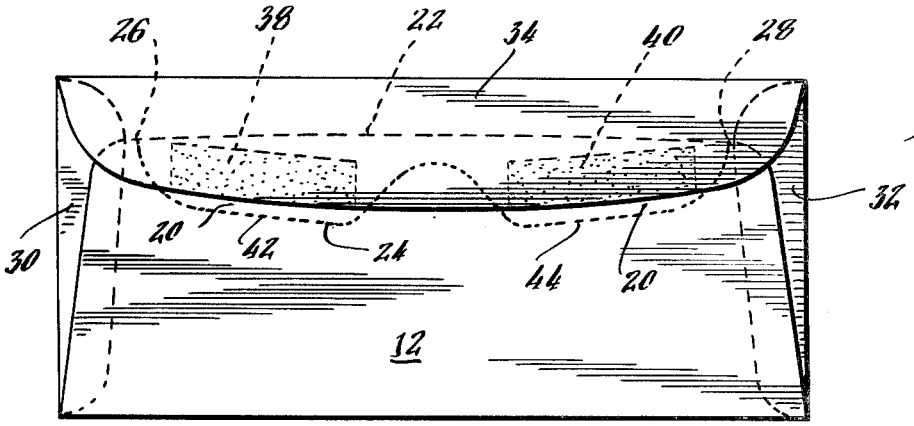
Fig. 2.
Fig. 3.
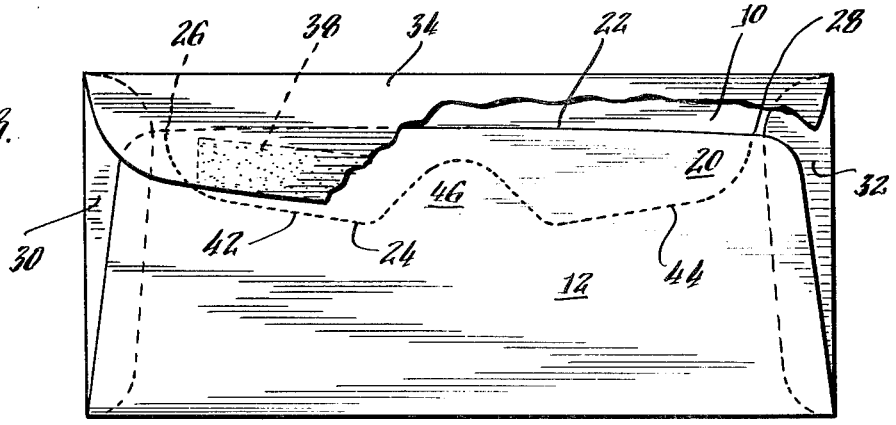

EASY OPENING ENVELOPE

BACKGROUND OF THE INVENTION

The present invention relates to envelopes and more particularly to an easily opened, highly secure envelope.

A substantial amount of business of all kinds is transacted by means of national or international postal systems. For example, mail-order merchandisers not only use the mails to ship ordered products but also to receive payments from purchasers of those products. Similarly, consumers use the mails extensively when they pay for insurance policy premiums, credit card purchases, utility bills, bank loans, etc.

The volume of mail received on a daily basis by firms engaged in businesses such as those identified above can be overwhelming. Notwithstanding this, firms try to stay current on opening incoming mail both to avoid unmanageable backlogs of mail and to optimize their cash flow where the envelopes contain checks or money orders.

The most rudimentary solution to the problem of handling incoming mail is to either hire additional people for the express purpose of manually opening incoming mail or to assign existing employees the part time task of manually opening mail at peak receiving times. The drawback to this approach is that the recipient incurs increased labor costs which must be passed on to the consumer. Also, employees assigned the part time task of opening incoming mail may neglect other equally critical duties.

To speed up the opening of incoming mail, a number of mail-slitting machines have been developed and marketed. While the use of such machines can reduce labor costs, the cost of acquiring and maintaining such machines can be significant. Also, such machines can damage the contents of envelopes being opened, particularly where the machine encounters a staple or paper clip within the envelope.

Large volume mail users have also attempted to facilitate handling of incoming mail by providing easy opening envelopes in which customers might return payments and the like. One well known type of easy opening envelope has a line of perforations parallel to one end so that a recipient can simply tear off the end of the envelope in order to remove the contents.

The problem with known types of easy opening envelopes is that they sometimes open too easily, causing the contents of the envelope to be spilled in transit as a result of rough handling. Some consumers, being aware of this problem, securely tape the envelopes shut before mailing to prevent accidental opening. Such an action makes it much more difficult for the recipient to open the envelope quickly and to remove the contents.

SUMMARY OF THE INVENTION

The present invention is an envelope which can be readily opened manually but which is resistant to accidental opening due to rough handling during mailing.

An envelope constructed in accordance with the present invention includes a front panel and a parallel back panel having a common edge with the front panel. The back panel has a tear panel adjacent its upper edge defined in part by perforations connecting a first point on the upper edge to a second spaced point. The envelope further includes a flap connected to the upper edge of the front panel. The flap overlays a substantial part or all of the tear panel when closed. Adhesive means are provided for securing the flap to the tear panel. The flap and tear panel have a non-adhered area which permits a user to insert a finger or implement beneath the flap to open the envelope by pulling the flap and adhering tear panel away from the back panel.

DESCRIPTION OF THE DRAWINGS

While the specification concludes with claims particularly pointing out and distinctly claiming that which is regarded as the present invention, details of a preferred embodiment of the invention may be more readily ascertained from the following detailed description when read in conjunction with the accompanying drawings wherein:

FIG. 1 is a plan view of a one-piece blank incorporating the present invention;

FIG. 2 is a plan view of a closed envelope made from the blank of FIG. 1; and

FIG. 3 is a plan view of the closed envelope with a portion of the flap cut away to show details of construction.

DETAILED DESCRIPTION

Referring to FIG. 1, the one piece blank shown there includes a generally rectangular front panel 10 and a generally rectangular back panel 12 connected to the front panel 10 at a fold line 14. The side edges of the back panel 12 may be tapered inwardly slightly and may be coated with adhesive strips 16 and 18. The back panel 12 includes a tear panel 20 defined in part by the free edge 22 of panel 12 and in part by a pattern 24 of perforations which extend from a first point 26 on edge 22 to a second spaced point 28.

First and second side flaps 30 and 32, respectively, extend from fold lines defining the side edges of the front panel 10. An envelope flap 34 extends from a fold line 36 at the upper edge of panel 10. In a preferred embodiment, flap 34 carries first and second strips of adhesive 38 and 40 contiguous to its outer edge. Preferably, the adhesive is a conventional moisture-activated material.

In erecting an envelope from the blank described above, side flaps 30 and 32 are folded inwardly against the inner surface of the front panel 10. Back panel 12 is then folded upwardly about fold line 14 to bring the adhesive coated areas 16 and 18 into contact with the surfaces of the side flaps 30 and 32. The envelope is mailed to the user in this state with flap 34 preferably being folded against back panel 12.

When the user has inserted the necessary material into the envelope, the adhesive strips 38 and 40 are wetted and the flap 34 is again brought into contact with the back panel 12. Referring to FIG. 2, the envelope flap 34 overlies substantially all of the area of the tear panel 20 with only segments 42 and 44 of the pattern of perforations being visible. Also, the adhesive strips 38 and 40 bond the flap 34 only to the tear panel 20. There is no bonding between the flap 34 and the lower portion of the back panel 12.

Referring to FIG. 3, when the envelope is received at the location at which it is to be opened, the person who is to open the envelope can insert a finger beneath the flap 34 in an adhesive-free area 46. Area 46 is between the adhesive strips 38 and 40 and includes a rounded excursion 48 in the pattern of perforations. When the flap 34 is lifted at area 46, the perforations in pattern 24 begin to break allowing the tear panel to be torn away from the back panel 12 with minimum effort. The rounded excursion at the center of the pattern 24 provides clearance for the finger or implement inserted under flap 34 while preventing that finger or implement from being caught between the flap 34 and any portion of the tear panel 20.

The perforation-defined tear panel 20 makes it a simple matter to open the envelope without breaking any adhesive bonds or without performing any cutting or slitting operation. At the same time, the fact that the envelope flap 34 overlies a substantial portion of the tear panel 20 prevents the panel 20 from being inadvertently opened due to rough handling during the mailing process. In addition, the tear panel lifts away from the envelope contents, reducing the chances that the contents will be torn during opening.

A preferred embodiment of the invention has been described. Variations and modifications will occur to those skilled in the art once they become acquainted with the basic concepts of the invention. For example, the adhesive strips 38 and 40 might be located on the face of the tear panel 20 rather than on the flap 34. Also, the size and shape of the various components of the envelope can be readily changed without departing from the spirit of this invention. Therefore, it is intended that the appended claims shall be construed to include these and other variations and modifications falling within the true spirit and scope of the invention.

What is claimed is:

1. An easy opening envelope comprising:

a front panel;

a back panel having a common edge with said front panel and extending parallel thereto, said back panel having a tear panel adjacent its upper edge defined in part by perforations connecting a first point on the upper edge to a second, spaced point, said perforations extending generally parallel to the upper edge of said back panel except for an excursion portion which extends towards the upper edge of said back panel;

an elongated envelope flap connected along one side edge to an opposing edge of said front panel, said flap adapted to overlie a substantial portion of, but not all of, said tear panel when closed, the opposite side edge of the flap, when closed, extending generally parallel to but stopping short of said perforations that are generally parallel to the upper edge of the back panel; and adhesive means for securing said envelope flap to said tear panel over part of their facing surfaces, said adhesive means including spaced strips of adhesive material, each of said adhesive strips being formed at the free edge of said envelope flap, with the non-adhesive spacing area of the strips being located in facing relationship to said excursion portion of the perforations such that said envelope flap and said tear panel include a non-adhering area to permit a user to insert a finger or implement beneath the envelope flap in said non-adhering area to open said envelope by pulling the flap and adhering tear panel away from said back panel.

2. An easy opening envelope as defined in claim 1 wherein said envelope further includes inwardly-folded side flaps extending from opposite side edges of said front panel, said back panel being secured to said side flaps by adhesive coatings on facing surfaces.

* * * * *